US005103591A

United States Patent [19]

Szymanski

[11] Patent Number: 5,103,591

[45] Date of Patent: Apr. 14, 1992

[54] SWING-AWAY, EMERGENCY ESCAPE WINDOW

[76] Inventor: Donald E. Szymanski, 5060 S. 49 St., Omaha, Nebr. 68117

[21] Appl. No.: 716,052

[22] Filed: Jun. 17, 1991

[51] Int. Cl.[5] ..... E05F 1/00; E05B 65/10

[52] U.S. Cl. ..... 49/379; 49/141; 49/506

[58] Field of Search ..... 49/379, 506, 507, 141

[56] References Cited

U.S. PATENT DOCUMENTS 2,745,149 5/1956 Etling ..... 49/506
2,787,348 4/1957 Goodemote et al. ..... 49/141
4,237,654 12/1980 Landem et al. .
4,304,070 12/1981 Musacchia ..... 49/379 X
4,445,589 5/1984 Longenecker ..... 49/141 X
4,677,789 7/1987 Merry ..... 49/141 X
4,879,842 11/1989 Bailey .

*Primary Examiner*—Philip C. Kannan
*Attorney, Agent, or Firm*—Zarley, McKee, Thomte Voorhees & Sease

[57] ABSTRACT

A swing-away emergency escape window is provided which automatically swings outwardly from a closed position to an opened position when a latching handle is actuated. A method of converting a conventional window to the emergency escape window is described.

6 Claims, 5 Drawing Sheets

SWING-AWAY, EMERGENCY ESCAPE WINDOW

BACKGROUND OF THE INVENTION

This invention relates to an emergency escape window and more particularly to a swing-away, emergency escape window.

Many types of emergency escape windows have been provided for homes to enable a person or persons to evacuate the home in the case of fire. Heretofore, the only way that an emergency escape window could be installed in the wall of the home was to completely remove the window and replace the same with a factory fabricated window. The factory escape windows normally provide some means for opening a portion of the window. However, the entire window does not open which restricts or limits the size of the escape opening. Further, the factory escape windows frequently require extensive modification of the framed opening in which the conventional window was mounted. Yet another disadvantage of the factory emergency escape windows is the cost of the same.

It is therefore a principle object of the invention to provide an improved emergency escape window.

A further object of the invention is to provide an emergency escape window for use in the home or the like which is normally positioned in a closed position but which may be easily moved or swung outwardly from the framed window opening to permit egress therethrough.

Yet another object of the invention is to provide an emergency escape window which provides adequate opening to permit people to easily pass therethrough.

Yet another object of the invention is to provide an emergency escape window having an audible alarm associated therewith which is sounded when the window is opened to alert other people in the dwelling that an emergency exists and that the window has been opened.

Yet another object of the invention is to provide a method of converting a conventional window to a swing-away, emergency escape window without extensive modification of the framed window opening.

Still another object of the invention is to provide a swing-away, emergency escape window which has aesthetic characteristics.

These and other objects of the present invention will be apparent to those skilled in the art.

SUMMARY OF THE INVENTION

Figure 10:
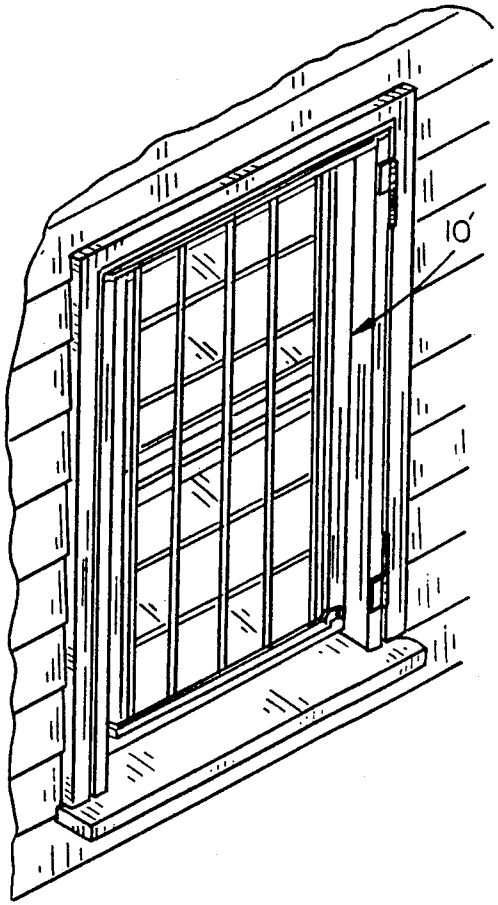
FIG. 10 is an outside perspective view of a different type of window.
Figure 9:
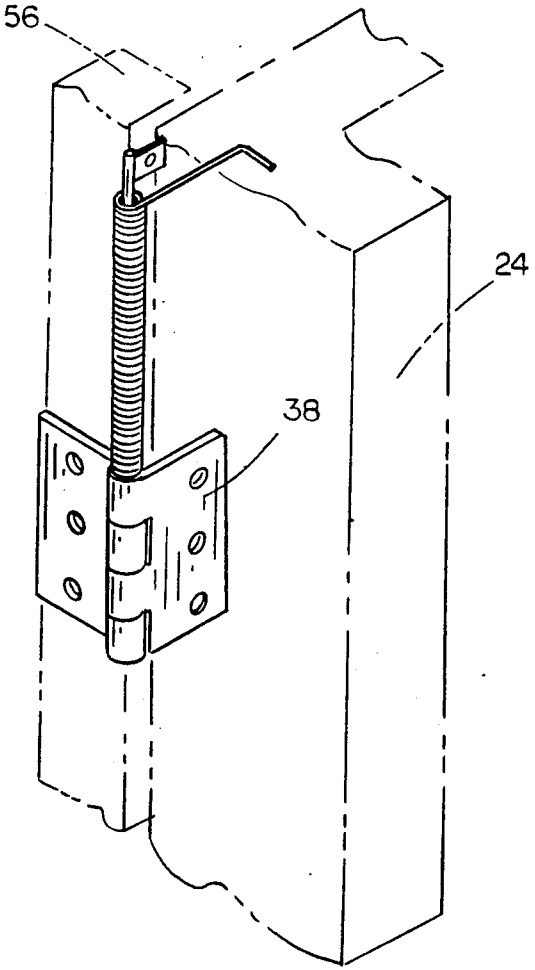
FIG. 9 is a perspective view illustrating one of the hinges employed on the window.
Figure 8:
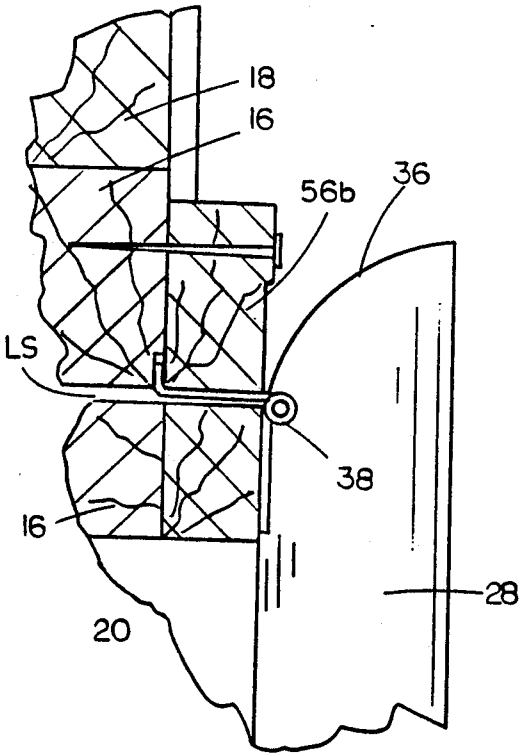
FIG. 8 is a partial sectional view illustrating the manner in which one end of the window sill is beveled to facilitate the opening of the sill.

The swing-away emergency escape window of this invention is referred to generally by the reference numeral 10 in FIGS. 1–9. The window 10 is only one form that the window may take and it can be seen in FIG. 10 that the emergency escape window 10' may be of the double-hung type if so desired.

Figure 1:
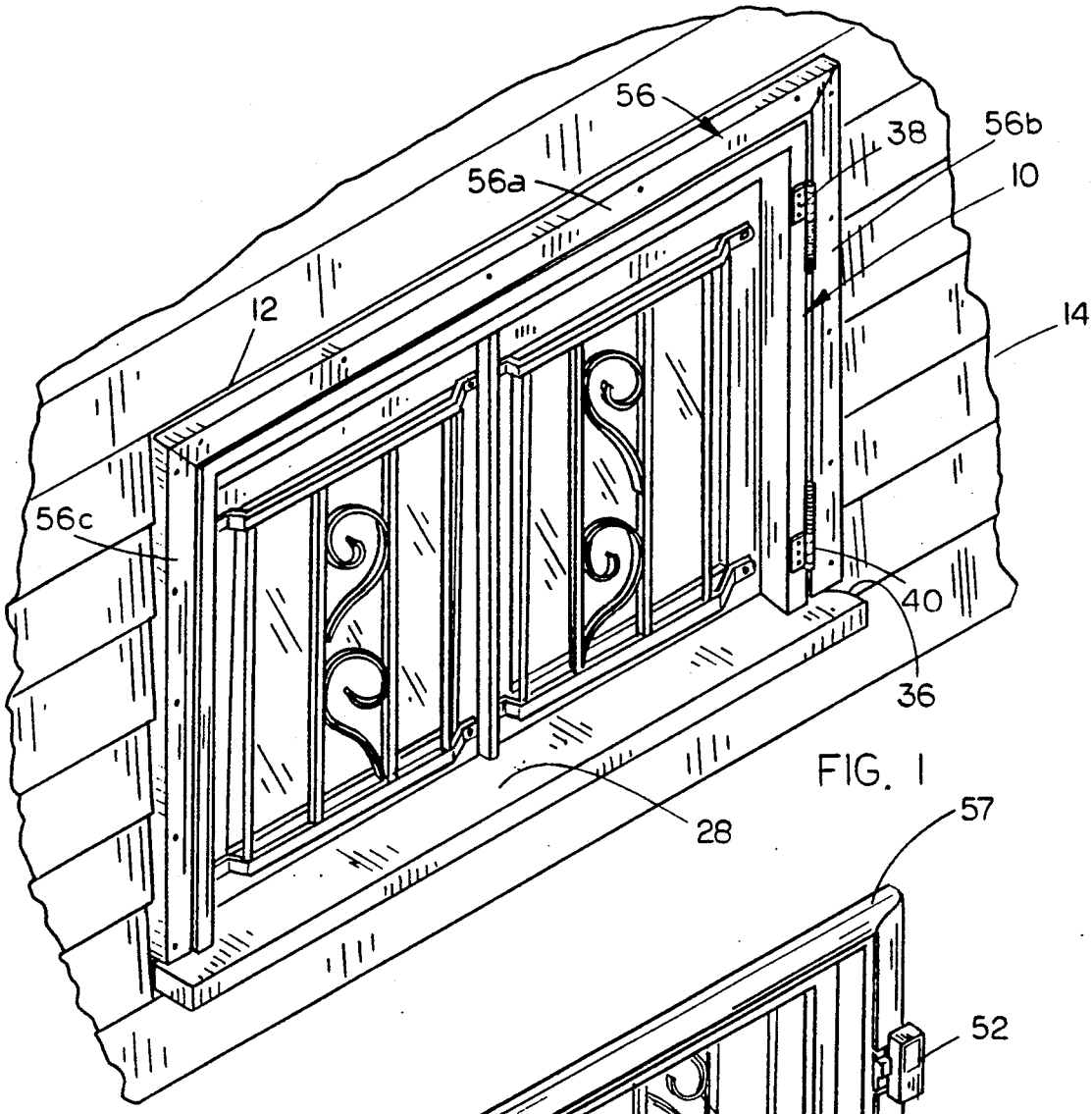
FIG. 1 is an outside perspective view of the window of this invention mounted in a framed window opening.
Figure 2:
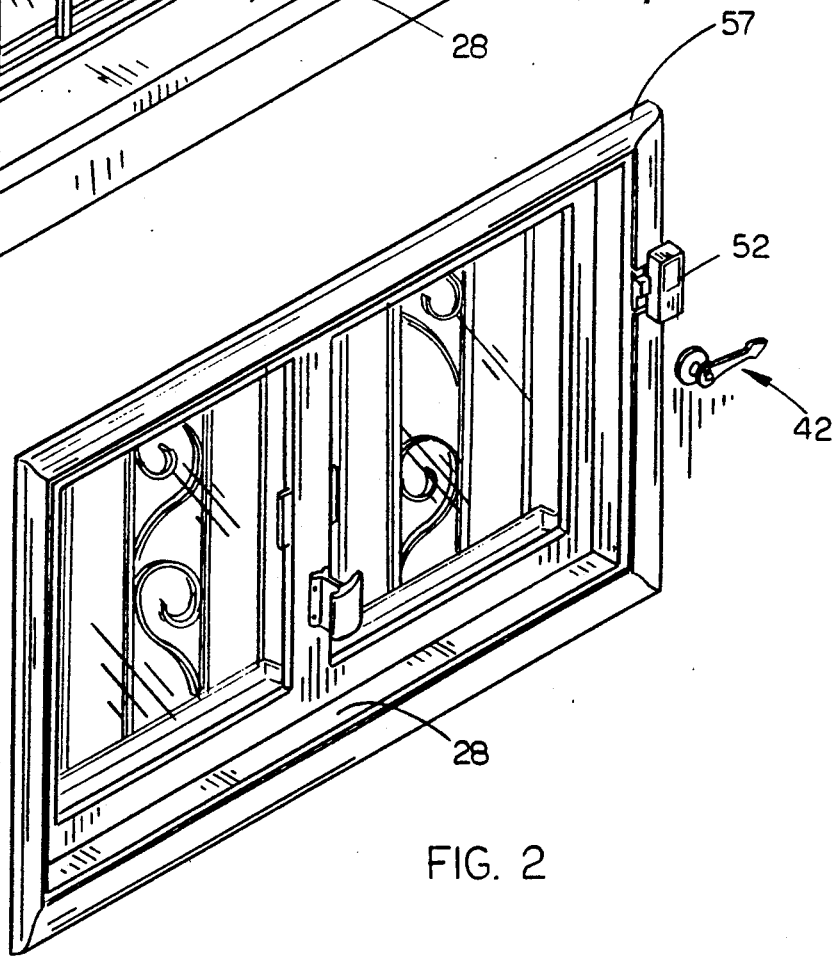
FIG. 2 is an inside perspective view of the window of FIG. 1.
Figure 3:
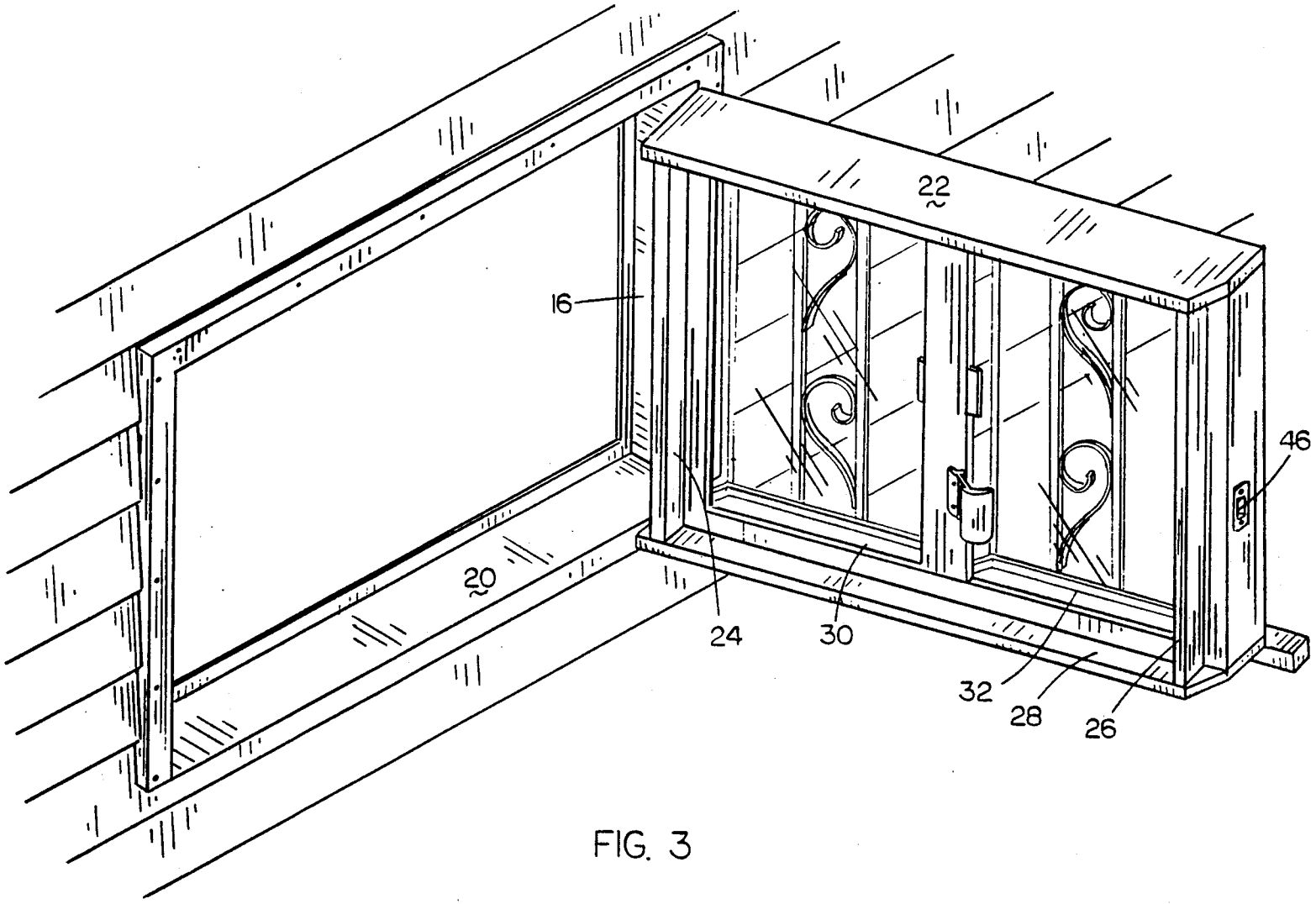
FIG. 3 is a view similar to FIG. 1 except that the window has been swung to its opened position.

Normally, windows are mounted in a framed opening referred to generally by the reference numeral 12 in FIG. 1. The framed opening 12 is formed in the wall 14 of a dwelling or the like. Normally, one side of the framed opening would be defined by a pair of vertically disposed 2×4s 14 and 15 with the other side of the framed opening being defined by a pair of 2×4s 16 and 18. Frequently, once a single 2×4 is provided at each side of the opening, the lower end of the framed opening is defined by a horizontally disposed plate 20 which is normally supported upon 2×4 studs. The upper end of the framed opening 12 is normally defined by a header which is not shown in the drawings.

A conventional window normally includes an upper frame member 22, opposite side jambs 24 and 26, and a bottom sill 28. In the embodiment of FIGS. 1–9, the window includes a pair of casement window units referred to generally by the reference numerals 30 and 32. The window 10 is normally positioned in the framed opening in a conventional fashion so that the upper frame member 22 is positioned below the header of the framed opening and so that the bottom sill 28 is positioned above the plate 20. The space between jamb 24 and 2×4 16 comprises a leveling space LS while the space between jamb 26 and 2×4 14 comprises a leveling space LS'. Brick molding 56 is nailed to the installed window so as to extend therearound as seen in the drawings and includes top molding **56*a*, and side moldings 56*b* and 56*c***.

The conventional window is converted to a swing-away, emergency escape window by sawing the window 10 free from its framed opening. The first step is to remove the inside trim 57 from the window. If there are any nails holding the window to its framed opening, the same are removed. The width between the side framing boards of the window is measured with those measurements being outlined on the exterior of the brick molding 56. The sawing line is created on the brick molding so that the person installing the window will know the location of the leveling spaces LS and LS'. The sawing line on the brick line will be the width of the frame boards plus one-quarter inch from the inside frame.

With a circular saw, the brick molding 56 is cut to a point as far as the blade will permit. The cutting is finished with a handsaw. The entire window is cut from its opening so that the window unit is free from its supporting members.

After the window has been removed, gears of the window frame on the lock side thereof are removed if there are any. One-quarter inch additional material is removed from the brick molding which is left attached to the window. When the window has been removed from its opening, the upper portion of top molding **56*a*** will remain with the house and the outer portions of the moldings 56b and 56c will remain on the house. The remaining portions of the molding will remain on the window unit which has been removed.

The hinge side of the window sill 28 is then beveled at the rear portion thereof to permit the sill to pivot. The beveled portion is referenced by the numeral 36.

A pair of spring loaded hinges 38 and 40 are then installed on the window as indicated in the drawings on the opposite of the lock side of the window.

Figure 6:
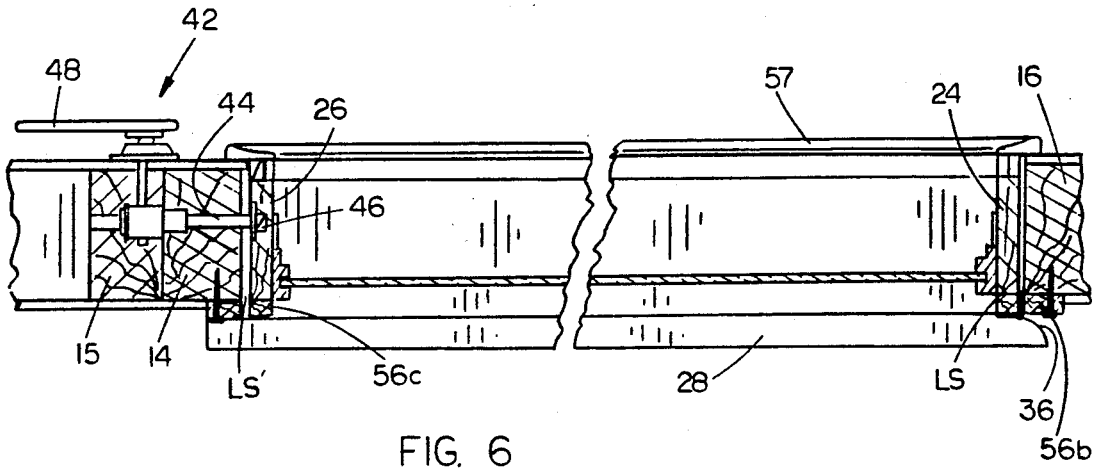
FIG. 6 is a horizontal sectional view of the window of FIG. 4.
Figure 7:
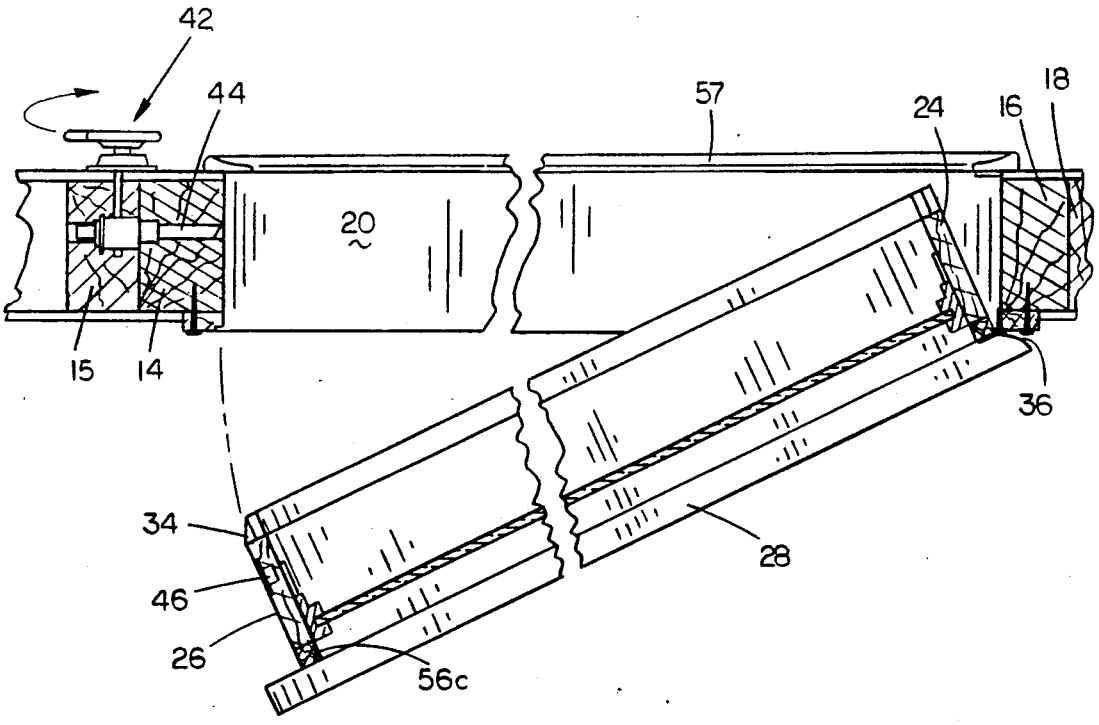
FIG. 7 is a view similar to FIG. 6 except that the window has been partially moved towards its opened position.

Suitable weather stripping is then applied to the window and the window is inserted back into the frame. The hinges are then secured to the brick molding. The inside trim 57 is then replaced by nailing the same to the wall surrouding the window unit. A hole is then drilled in the studs 14 and 15 to accommodate the plunger 44 of the latching assembly 42. The outer end of the plunger 44 is selectively received in a socket 46 created inside jamb 26 to selectively maintain the window in its closed position as seen in FIG. 6. Handle 48 controls the locking mechanism.

If desired, a chain 50 may be secured to the handle 48 and extended downwardly therefrom towards the floor so that an invalid could actuate the handle 48 if desired. Further, if a person was lying on the floor due to smoke conditions, the handle 48 could be actuated by means of the chain 50.

An audible alarm 52 is positioned at the inside surface of the window and is actuated when the window is opened to alert other members of the household that the window has been opened which would normally mean that a dangerous condition exists.

When it is desired to evacuate the premises, handle 48 is actuated which releases the plunger 44 from its socket 46. The spring-loaded hinges 38 and 40 automatically cause the window to be moved from the position of FIG. 6 to the position of FIG. 3 so that substantially all of the enlarged framed opening is available for an escape route. Simultaneously with the opening of the window will be the actuation of the audible alarm 52 to alert other members of the household.

Figure 4:
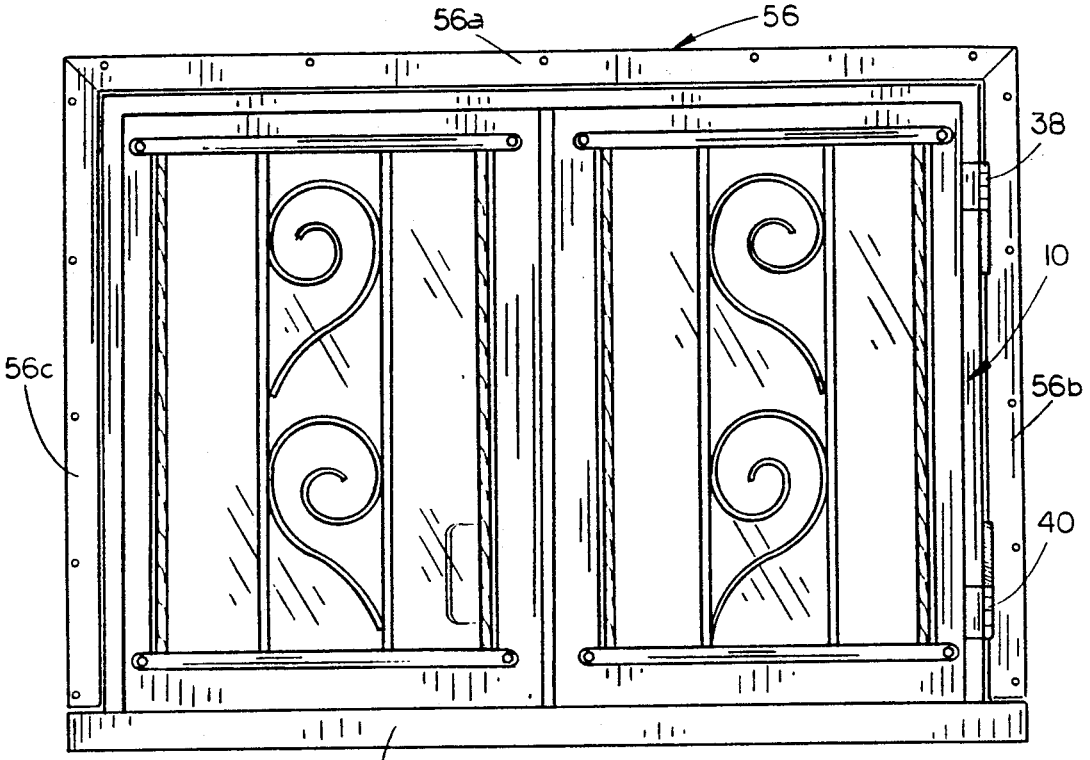
FIG. 4 is an outside elevational view of the window mounted in a framed opening.
Figure 5:
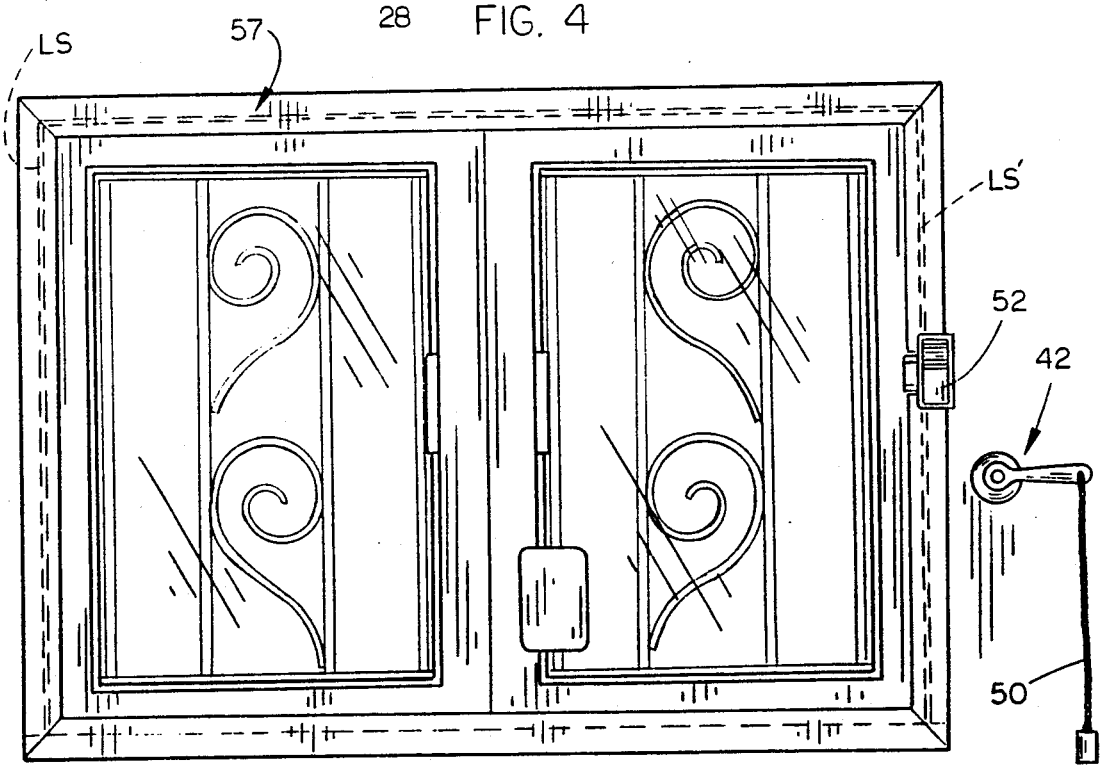
FIG. 5 is an inside elevational view of the window of FIG. 4.

FIGS. 4 and 5 illustrate that a security grill means 54 may be used with the window with the security grill opening with the window so as not to be in the escape route.

Thus it can be seen that the invention accomplishes at least all of its stated objectives.

I claim:

1. In combination with an opening in a wall of a building, said opening defined by horizontally disposed upper and lower edges, vertically disposed, opposite side edges, an exterior wall face, and a first portion of a brick molding comprising first and second portions associated in nesting relationship, said first molding portion extending around the upper and side edges of said opening on the exterior face of said wall;

a window having a horizontally disposed upper frame member, a horizontally disposed lower sill member, opposite side frames, and at least one glass pane positioned therebetween, said window being positioned in said opening, said window including said second portion of said brick molding, extending around the upper and side frame members of said window for juxtaposition in nested relation interior of said first molding portion;

at least a pair of hinges secured to one of said side frames of said window and its associated side edge whereby said window may be selectively hingedly moved from a normal closed position, wherein said window closes said opening, to an open position wherein said window has been swung outwardly relative to the building about said hinges, and latching means for maintaining said window in its said closed position.

2. The combination of claim 1 wherein a spring means is associated with at least one of said hinges to automatically move said window to its open position when said latching means is unlatched.

3. The combination of claim 1 wherein an audible alarm is operatively connected to said window for sounding an alarm when said window is opened.

4. The combination of claim 1 wherein security bars are provided on said window.

5. The method of converting a conventional, permanently installed window to an emergency escape window, said window comprising a top frame member, opposite side jambs, and a bottom sill member, said window being installed in a framed opening said window having brick molding positioned along its top frame member and said side jambs at the exterior surfaces thereof, comprising the steps of:

inserting a saw between said window and said framed opening, sawing around both sides and the top of said window and through said brick molding to permit said window to be removed from said framed opening, removing said window from said framed opening, trimming additional material from the brick molding or the framed opening, installing at least a pair of hinges on one of said side jambs, positioning said window in the framed opening, securing said hinges to the associated side of the framed opening whereby said window may be swung outwardly, about said hinges, from a normal closed position to an open position, so that said enlarged framed opening may be used as an emergency escape route, and installing a latching means so that said window may be maintained in its said closed position.

6. The method of claim 5 wherein an audible alarm means is also installed on said window and said framed opening for sounding an audible alarm when said window is opened.

* * * * *